US007611665B2

(12) United States Patent
Richaud et al.

(10) Patent No.: US 7,611,665 B2
(45) **Date of Patent: *Nov. 3, 2009**

(54) LADLE BOTTOM

(75) Inventors: Johan Richaud, Dundas (CA); Lawrence J. Heaslip, Burlington (CA); James D. Dorricott, Burlington (CA)

(73) Assignee: Vesuvius Crucible Company, Wilmington, DE (US)

( * ) Notice: Subject to any disclaimer, the term of this patent is extended or adjusted under 35 U.S.C. 154(b) by 298 days.

This patent is subject to a terminal disclaimer.

(21) Appl. No.: 11/506,095

(22) Filed: Aug. 17, 2006

(65) Prior Publication Data

US 2007/0029708 A1 Feb. 8, 2007

Related U.S. Application Data

(63) Continuation-in-part of application No. 10/503,191, filed on Jul. 30, 2004, now Pat. No. 7,112,300.

(51) Int. Cl.

| | |
|---|---|
| ***C21B 3/00*** | (2006.01) |
| ***C22B 21/00*** | (2006.01) |
| ***C21B 3/04*** | (2006.01) |
| ***C21B 7/14*** | (2006.01) |
| ***C21C 7/00*** | (2006.01) |
| ***B22D 41/08*** | (2006.01) |

(52) U.S. Cl. ..... 266/275; 266/200; 266/227; 266/230; 222/594

(58) Field of Classification Search ..... 266/200, 266/230, 275, 227; 222/594

See application file for complete search history.

(56) References Cited

U.S. PATENT DOCUMENTS

| | | | |
|---|---|---|---|
| 4,746,102 | A | 5/1988 | Gilles |
| 5,196,051 | A | 3/1993 | Heaslip |
| 5,879,616 | A | 3/1999 | Erny |

*Primary Examiner*—Roy King
*Assistant Examiner*—Caitlin Fogarty
(74) *Attorney, Agent, or Firm*—Thomas Clinton; James R. Williams; Donald M. Satina

(57) ABSTRACT

The present invention relates to a ladle block for use in a bottom of a molten metal ladle. The ladle block reduces the amount of contaminants, particularly slag, exiting the ladle during casting operations. The ladle block includes a floor defining an outlet and sidewalls substantially orthogonal to the floor. The floor and sidewalls define a channel having dimensions of length, width and height. Channel dimensions are determined from the Froude number, which is based at least partially on the casting flow rate.

14 Claims, 6 Drawing Sheets

LADLE BOTTOM

This application is a continuation-in-part of U.S. Pat. No. 10/503,191, filed Jul. 30, 2004 now U.S. Pat. No. 7,112,300, which is incorporated herein by reference.

FIELD OF THE INVENTION

This invention relates generally to refractory article and, more particularly, to a refractory shape used in the transfer of molten metal in a continuous casting operation.

BACKGROUND

A ladle is a vessel that is used to hold or transport a batch of liquid metal during metallurgical operations. The ladle lining includes a generally horizontal ladle bottom that is fashioned from refractory materials, such as blocks, bricks, or castable materials. The ladle bottom includes an outlet defining a bore that provides a generally vertical conduit for the outflow of liquid metal during casting. Typically, the outlet is encircled by or encompassed within a block called the nozzle block. The nozzle block is set within and is surrounded by the remainder of the ladle bottom, which most commonly comprises bricks. To facilitate the casting process, the nozzle block is very typically offset from the center of the ladle bottom and is generally located closer to the periphery of the ladle bottom than to the center of the ladle bottom.

A layer of slag frequently covers the top surface of the liquid metal, such as in the production of steel. During casting, the liquid metal is drained from the ladle though the outlet located in the ladle bottom. While draining, the metal will, desirably and advantageously, completely empty from the ladle without contamination of the metal by slag or other contaminates, such as entrained particles. Contamination is undesirable and may cause difficulties in casting or refining operations as well as defects in the intermediate or final metal products.

Contamination can occur from both floating and entrained slag. Slag is typically less dense than liquid metal and generally floats in a separated layer on the surface of a quiescent batch of liquid metal. During the draining of the liquid metal, slag can become entrained within the flowing stream. Entrainment is the presence of slag particles in the molten steel. Entrainment often occurs when turbulent flow of the liquid metal disturbs the interface between molten metal and slag. Such turbulence can cause molten metal and slag to mix. Under quiescent conditions, entrained slag would eventually float to the surface; however, the turbulence of casting can maintain a substantial amount of entrained slag in the molten metal. Ideally, any solution to the problem of slag contamination would address both floating and entrained slag.

As the metal drains from the ladle, the floating slag approaches the outlet and the likelihood of contamination of the metal stream by slag increases. An operator will stop the pour when he detects slag in the molten metal stream exiting the ladle. The operator may even stop the pour prematurely to avoid slag in the ladle outflow. The slag and metal remaining in the ladle are discarded. Discarding metal decreases yield, which is costly and inefficient but, at the same time, is necessary to reduce slag contamination.

Various methods and articles exist to detect slag in the ladle or the ladle outflow. Frequently, these methods require action by the operator and include electronic, electro-magnetic and sonic detection devices that are placed inside and outside the ladle. For example, a detector placed in the ladle can detect a drop in the level of molten metal by measuring a change in detector output when floating slag intersects the detection region. Similarly, sonic pulses can identify the presence of slag in the ladle outflow. Both techniques only detect the presence of slag and do not actively decrease the presence of slag in the outflow.

Prior art includes articles designed to reduce the outflow of slag from the ladle. U.S. Pat. Nos. 4,746,102 and 5,879,616 teach ladle bottoms having a small well immediately above the ladle outlet. Both patents describe the well as preferentially collecting molten metal instead of slag, thereby improving yield as the ladle empties. Unfortunately, the patents only prevent floating slag from exiting the ladle. Entrained slag is free to exit the ladle.

U.S. Pat. No. 5,196,051 describes a ladle bottom for reducing entrained slag. The ladle bottom comprises means for entrapping slag before the slag reaches the ladle outlet. The means extend upwards from the ladle bottom and include elongated castellations that approach the outlet. One embodiment shows castellations radiating symmetrically from the outlet. The symmetrical castellations are described as reducing vortexing, which leads to slag entrainment. Notably, the castellations are not described as promoting a reduction of entrained slag already present in the molten metal.

Prior art does not teach a ladle bottom that simultaneously reduces the outflow of both entrained slag and floating slag. A need remains for an article capable of capturing entrained slag and allowing molten metal to flow from a ladle before floating slag. Preferably, the article could be quickly installed in an existing ladle bottom.

SUMMARY OF THE INVENTION

The present invention relates to a metallurgical ladle and more particularly to the bottom of the ladle having an outlet through which the molten metal can drain and a method to increase the fraction of liquid metal that can be drained from the ladle through the outlet without contamination by slag.

An object of the present invention is to increase the efficiency of the ladle draining operation, including reducing the amount of discarded metal, avoiding the premature flow of slag through the outlet, and reducing the contamination of slag in the molten metal effluent. The invention includes a ladle bottom drain block, which directs and controls the flow of liquid metal from the ladle so as to minimize the contamination of the liquid metal by slag. The drain block will comprise at least some portion of the total ladle bottom.

The drain block obstructs or impedes the discharge of contaminants from the outlet. Preferably, the invention retards entrainment of non-metallic materials, such as slag particles or globules, in the liquid metal exiting through the outlet until all or very nearly the entire liquid metal bath in the ladle has exited the ladle. Preferably, the drain block is a minor portion of the ladle bottom yet still controls the outflow while retarding the release of slag from the ladle.

In a broad aspect, the invention includes a drain block comprising a plurality of terraces and at least one flow channel that directs the stream of molten metal to the outlet of the ladle. The terraces comprise generally horizontal faces that are substantially separated by at least one flow channel comprising sidewalls and a bottom face. The terraces permit entrained slag to precipitate from the molten metal. The channel allows uncontaminated liquid metal to flow to the outlet hole and drain from the ladle even when the metal level is very low and the floating slag layer is closely approaching the outlet.

In one embodiment, the flow channel may have a plurality of flow channels, which allow the collection of liquid metal from regions of the ladle that are remote from the outlet. The flow channels then feed the collected metal to the outlet. In a preferred embodiment, the depth of the channel increases in steps towards the outlet and terminates in a deepest face surrounding the outlet.

DETAILED DESCRIPTION OF THE INVENTION

Figure 1:
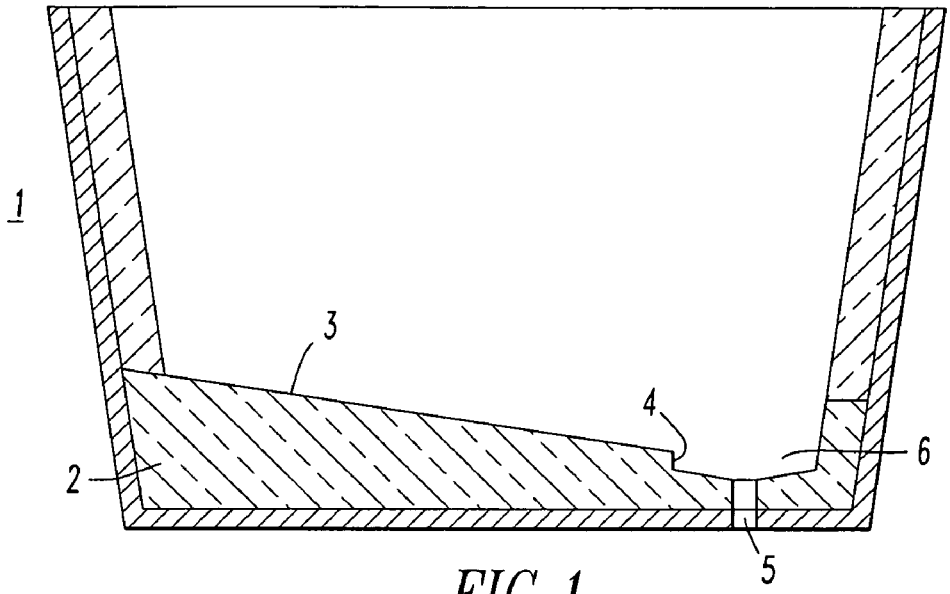
FIG. 1 PRIOR ART
FIG. 1 is a cross-section of a prior art ladle, including the ladle bottom and outlet.

FIG. 1 shows a ladle 1 of the prior art having a bottom 2. The bottom 2 comprises an inclined portion 3 and a vertical portion 4 adapted to direct molten metal in the ladle 1 to an outlet 5. The vertical portion 4 creates a well 6 immediately above the outlet 5. Molten metal is directed to the outlet 5 by the inclined portion 3, and collects in the well 6 before any slag, which may be floating on the molten metal. The well 6 is described as increasing the amount of molten metal that can pass through the outlet 5 before floating slag contaminates the outflow.

Figure 2:
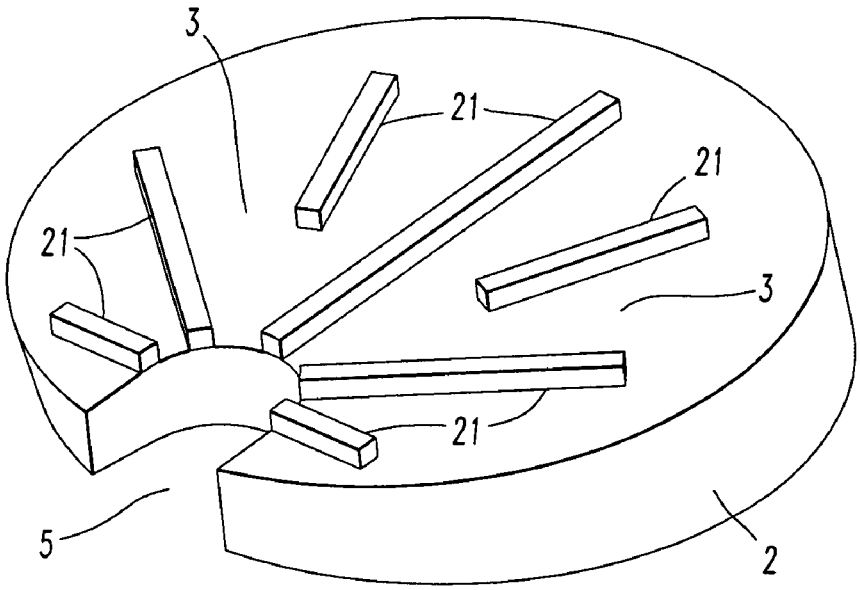
FIG. 2 PRIOR ART
FIG. 2 is perspective view of a prior art ladle bottom having castellations radiating from the outlet.

FIG. 2 shows another ladle bottom 2 of the prior art having an inclined surface 3 directed toward the outlet 5. Molten metal, being heavier than slag, is expected to reach the outlet 5 before any floating slag. A plurality of castellations 21 rises from the inclined surface 3. The castellations are described as reducing vortexing, thereby decreasing the likelihood slag will entrain in the molten metal. Less entrained slag would presumably decrease the amount of slag in the outflow. Only the inclination of the bottom 2 deters floating slag from exiting the ladle.

Figure 3:
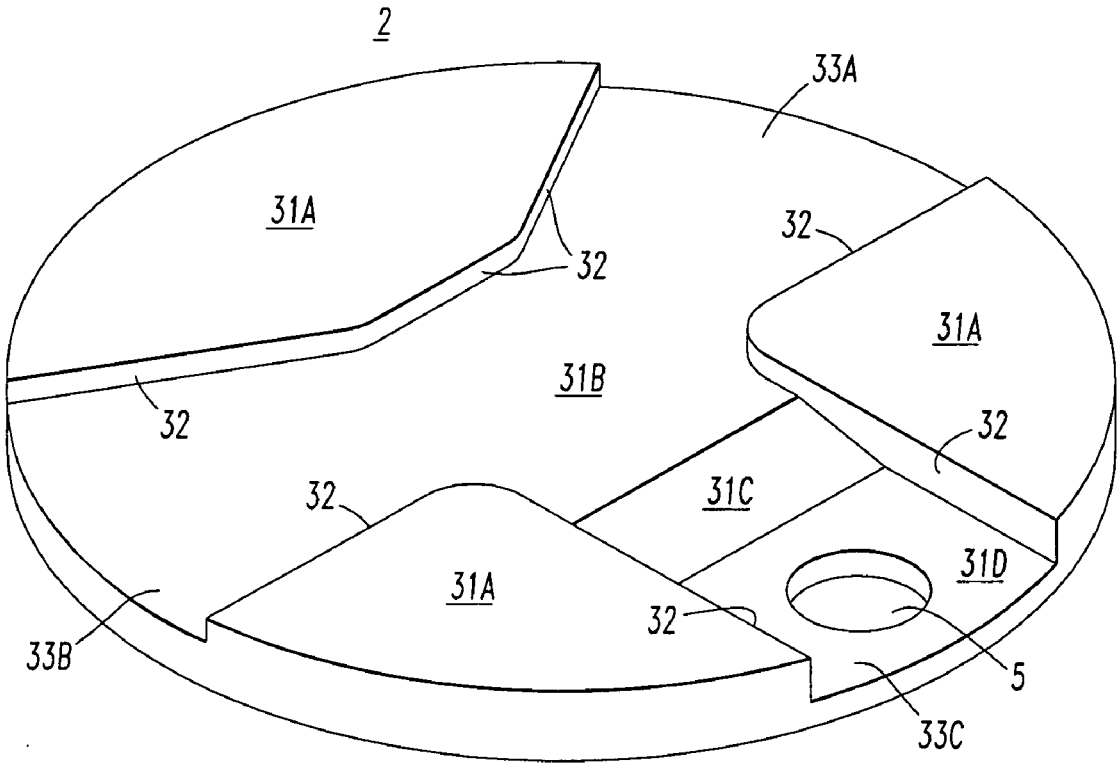
FIG. 3 is a perspective view of a first embodiment of a ladle block of the present invention.

FIG. 3 shows one embodiment of a ladle block 34 of the present invention. In this embodiment, the ladle block 34 forms the entirety of the ladle bottom 2. Not shown are the walls of the ladle that would surround the block and extend upward from the ladle bottom 2 to contain the liquid metal and slag. The ladle block 34 includes an outlet 5, which is normally at the low point of the ladle. The block 34 also comprises a plurality of faces 31 and sidewalls 32 that are exposed to the liquid metal. Sidewalls 32 are preferably substantially vertical relative to the faces 31. The sidewalls 32 may also be curved, chamfered, or otherwise shaped to permit head pressure on the flow above the outlet and decrease slag contamination.

The faces 31 include a plurality of uppermost faces 31A, which are generally horizontal or tilted away from the outlet. In association with adjacent sidewalls 32, the uppermost faces define terraces. The terraces may be at different heights relative to the outlet. The terraces may also vary in thickness depending on casting conditions, such as the type and grade of molten metal, use of gas purging, impact on the ladle bottom during filling with molten metal, expected erosion, etc.

The remaining faces 31 include at least one intermediate face 31B, at least one sloping face 31C, and at least one outlet face 31D. Intermediate face 31B is higher above the outlet 5 than sloping face 31C and outlet face 31D but at a lower level than uppermost faces 31A. Intermediate face 31B converges toward the sloping face 31C. Preferably, the intermediate face 31B is inclined toward sloping face 31C.

Sloping face 31C slopes upward from the outlet face 31D to intermediate face 31B, thereby defining an elevation drop from the intermediate face 31B to the outlet face 31D. The inclination of the sloping face 31C is greater than the average inclination of the intermediate face 31B, and can vary from a gentle slope to a perpendicular drop depending on conditions. As the slope of the sloping face 31C approaches perpendicular, the combination of sloping face 31C, sidewalls 32 and outlet face 31D may define a well around the outlet 5.

The outlet face 31D includes the outlet 5 and is preferably is shaped to direct molten metal toward the outlet 5. The outlet face 31D should be the lowest face 31 to ensure a higher yield of molten metal outflowing from the ladle.

The sidewalls 32 and lower faces 31B-D form a flow channel 33. The present embodiment shows a flow channel 33 having three branches 33A-C, which separate the uppermost faces 31A from one another. At least one branch is an outlet branch 33C. The branches may each be at different heights and, preferably, the outlet branch 33C including face 31D is the lowest.

During casting, both floating and entrained slag tend to settle on uppermost faces 31A as liquid metal drains into the flow channel 33. Any remaining slag then tends to settle on the intermediate face 31B as molten metal flows down the sloping face 31C, the outlet face D, and through the outlet. A sharply inclined sloping face 31C can define a well, which reduces contamination of the outflow by floating slag.

Terracing the ladle block while providing flow channels for liquid metal permits the liquid metal to exit the outlet with reduced slag contamination. The terraces and sidewalls, collect or trap slag while permitting molten metal to continue towards the outlet. This phenomenon takes advantage of the lower density of slag and its higher viscosity in comparison to liquid metal.

Slag movement toward the outlet is retarded by friction against the ladle block. The present invention takes advantage of this fact by creating a plurality of slag-entrapping features. For example, as the liquid metal and slag settle onto an uppermost terrace, the molten metal flows off the terrace into the channel, while the more viscous slag is stranded on the horizontal face. Successive terraces can further improve separation of slag from the liquid metal until, at the outlet, the liquid metal is substantially free of slag contamination.

The invention anticipates various terrace configurations. Factors influencing the choice of configuration include the type or grade of liquid metal, the impact of the flow onto the ladle bottom, gas purging elements, and the geometry of the ladle. The uppermost terrace may be higher, that is, thicker, or more or less numerous to accommodate more energetic flow, corrosive metals or ladle geometry.

Figure 4:
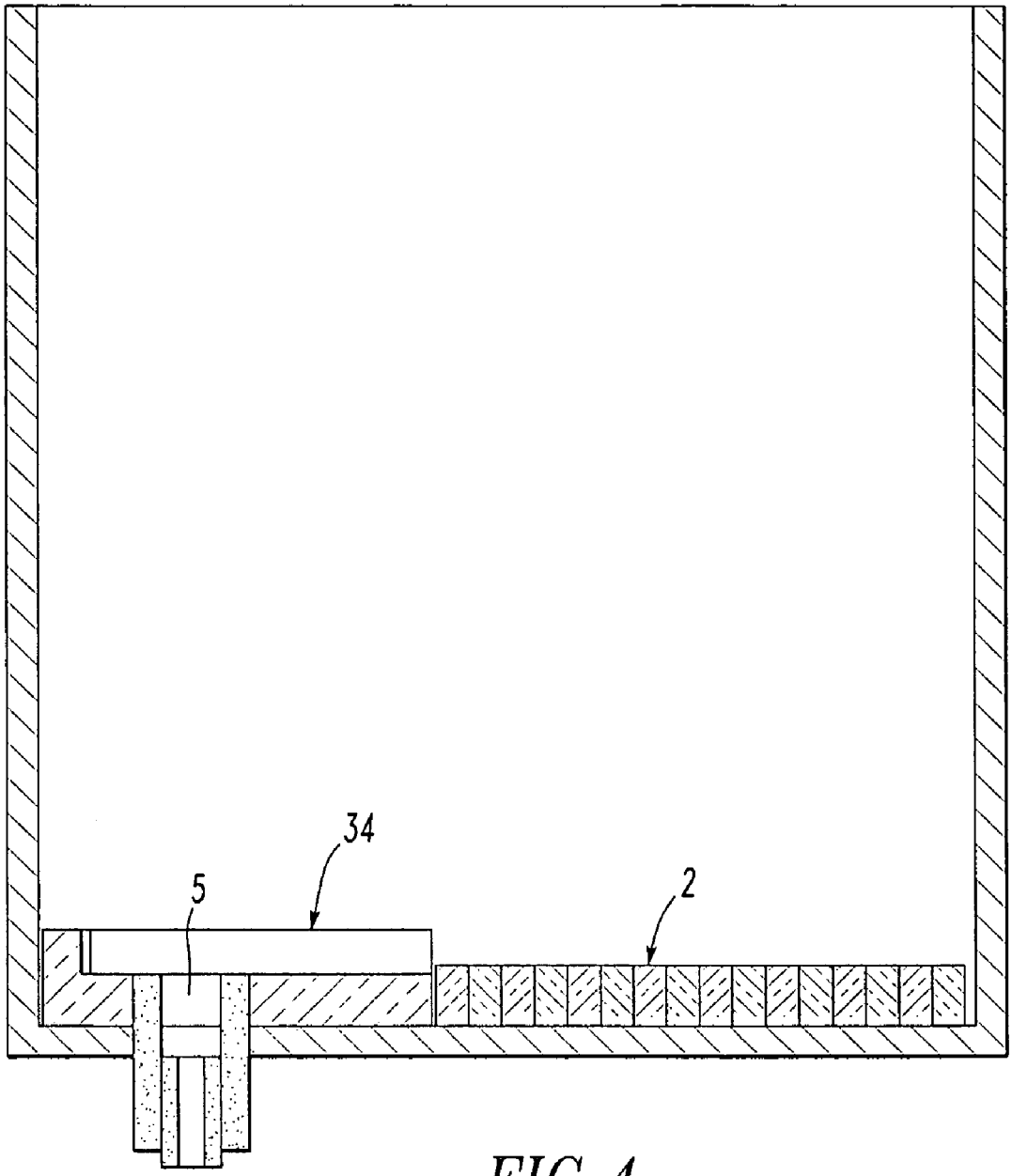
FIG. 4 is a cross-section view ladle comprising a second embodiment of a ladle block of the present invention.
Figure 5:
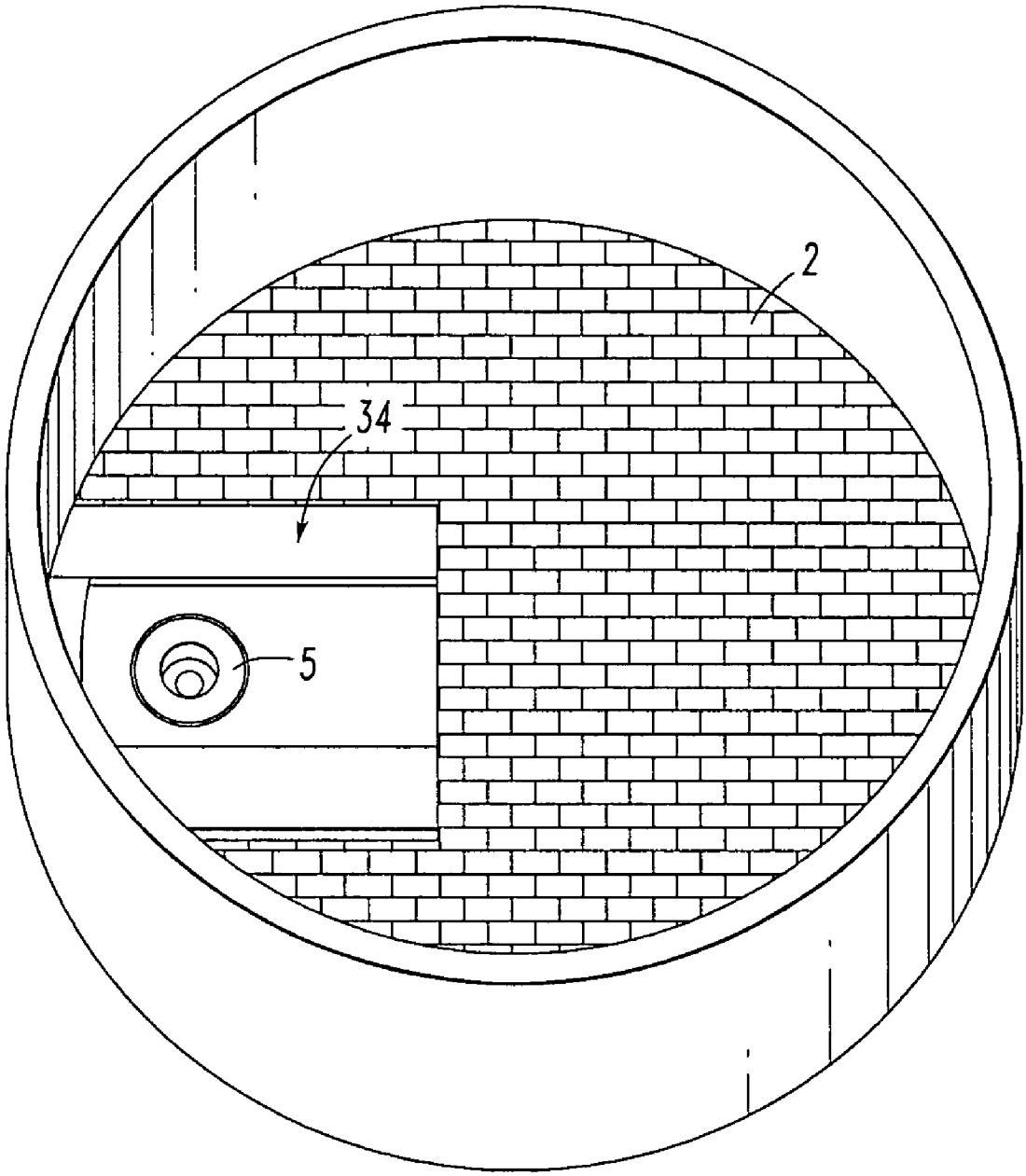
FIG. 5 is a top view of the ladle block of FIG. 4.

FIGS. 4 and 5 show an alternative embodiment of the invention where the ladle block 34 forms only a portion of the ladle bottom 2. The ladle block 34 surrounds the outlet 5. The ladle block 34 obstructs and impedes the flow of contaminants in the liquid metal outflow until nearly all of the liquid metal has exited the ladle. Contaminants include slag, non-metallic materials, inclusion particles generated at the slag/metal interface and slag globules.

Figure 6:
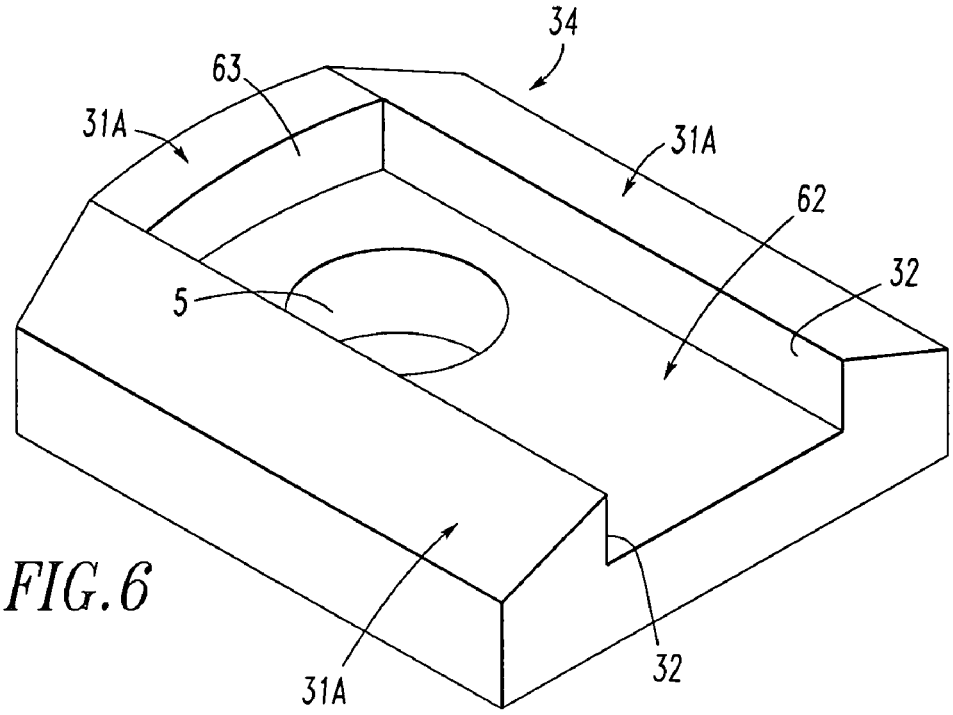
FIG. 6 is a perspective view of the ladle block of FIG. 4.
Figure 7:
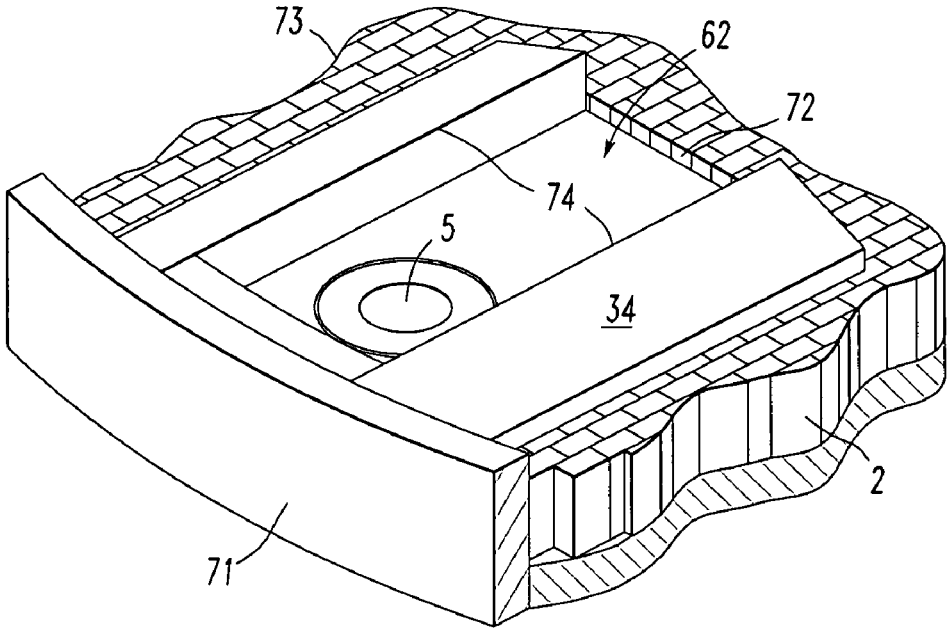
FIG. 7 is a cut-away perspective view of the ladle block as set in a bricked ladle bottom.

FIG. 6 shows the ladle block 34 comprising sidewalls 32, a floor 62, and a backwall 63 defining a channel. Uppermost faces 31A extend from the sidewalls 32 and preferably tilts away from outlet 5. At least two uppermost faces 31A will be present. A third uppermost face 31A may be present where the backwall 63 does not abut the ladle wall. FIG. 7 shows the ladle block 34 set into a ladle bottom 2. The outlet 5 is often off center in the ladle bottom so that the ladle block 34 will be set in the ladle bottom 2 next to the ladle wall 71. Preferably, the top edges 74 of the ladle block 34 are above the surface 73 of the ladle bottom 2, and the channel floor 62 is at a depth 72 slightly below the surface 73 of the ladle bottom 2. Even in this embodiment, the ladle block 34 provides an effective, efficient, and yet relatively small, shape for the direction and control of liquid metal outflow while reducing contamination of the metal outflow by slag. The remainder of the ladle bottom 2 can be fashioned in any of the convenient and cost effective manners known in the art, such as refractory brick or castable material.

Figure 8:
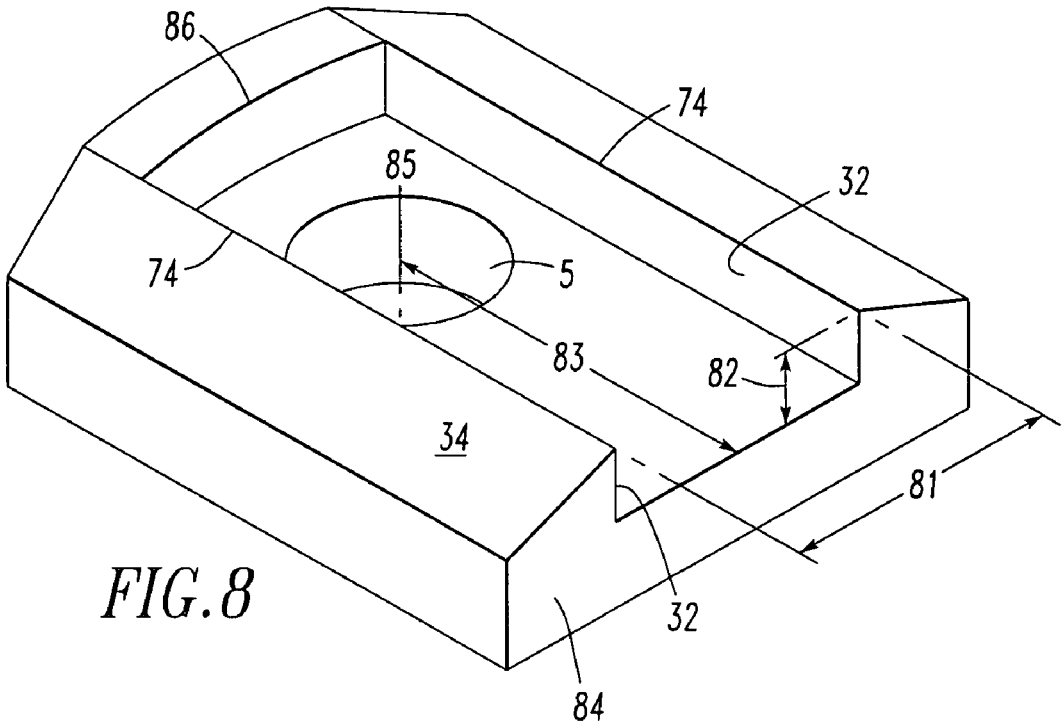
FIG. 8 is the ladle block showing dimensions.

FIG. 8 shows that the channel formed in ladle block 34 can be characterized by channel width 81, channel depth 82, and channel length 83. The channel width 81 is measured generally orthogonally to the channel sidewalls 32. The sidewalls may be parallel; however, the width may change along the channel length. The channel depth 82 is the minimum vertical depth of the channel from the floor to the top edges 74 of the ladle block 34. The sidewall top edges 74 need not be of the same height as the end wall top edge 86. The channel length 83 is measured from the entry end 84 of the channel to the center 85 of the outlet 5.

Casting throughput, Q, will determine the range of acceptable channel widths 81, while channel depth 82 and channel length 83 must exceed certain minimums for the ladle block 34 to be effective at reducing the outflow of contaminants during the final stages of liquid metal draining. These relationships are shown by the equations below:

$$D_{min}=K_1\cdot Q^{2/3} \quad (1)$$

$$W_{max}=K_2\cdot D_{min}/D \quad (2)$$

$$W_{min}=K_3\cdot D_{min}/D \quad (3)$$

$$L_{min}=K_4\cdot W \quad (4)$$

where Q is in $m^3/s$; $D_{min}$ is the minimum required channel depth; D is the actual depth of the channel; $W_{max}$ is the maximum allowed channel width; $W_{min}$ is the minimum required channel width; W is the actual width of the channel; $L_{min}$ is the minimum required channel length; $K_1=1.0$; $K_2=1.5$; $K_3=0.5$; $K_4=0.5$; and the dimensions of depth, width and length are in meters. Obviously, values for the constants will change proportionally with the units of Q and the dimensions of the ladle block.

One skilled in the art would appreciate that flow in an open channel is characterized by a Froude number. The Froude number, Fr, is a dimensionless parameter that relates kinetic and potential energies of the flow. A low (subcritical) Froude number corresponds to slow, tranquil flow, and a high (supercritical) Froude number corresponds to rapid and potentially turbulent flow. The Froude number is defined as:

$$Fr=Q^2/(g\cdot W^2D^3), \quad (5)$$

where g is gravity. Generally, flow with a Froude number below one is subcritical and a Froude number above one defines supercritical flow.

The denominator represents the speed of a small wave on the water surface relative to the speed of the water. At critical flow, the surface wave equals the flow velocity, and any disturbance to the surface will remain stationary. In subcritical flow, the flow is controlled from a downstream point and information is transmitted upstream. This condition leads to backwater effects. Supercritical flow is controlled upstream and disturbances are transmitted downstream. The inventors have determined that subcritical flow reduces contaminants in the outflow from the ladle. To this end, the inventors sought to reduce the ratio of kinetic energy to potential energy, thereby reducing slag contamination in the liquid metal flowing from the ladle.

Assuming a constant Q and W, the Froude number will be sufficiently subcritical to reduce substantially slag contamination in liquid metal draining from a ladle so long as the channel depth, D, is greater than a critical depth, $D_{min}$, and so long as the channel depth, W, is correct in size in relation to the ratio of the critical channel depth $D_{min}$ and the actual channel depth, D.

Equation (5) implies that $D_{min}$ should be proportional to $Q^{2/3}$, and that the constant $K_1$, from equation (1) would equal $(Fr\cdot g\cdot W^2)^{-1/3}$. The inventors have confirmed via process modeling and dynamic analysis that this two-thirds power relationship between $D_{min}$ and Q is accurate and that $K_1$ in SI units is approximately 1 within the limitations on channel width, W, and channel length, L, defined by equations (2), (3) and (4).

Figure 9:
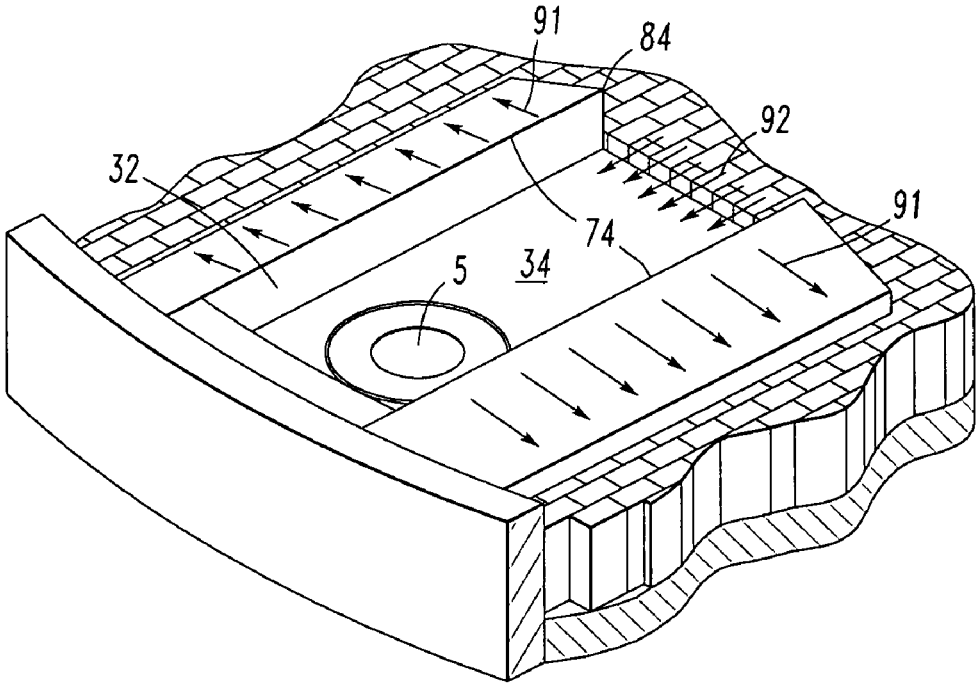
FIG. 9 shows flow patterns of liquid metal around the ladle block.

FIG. 9 illustrates schematically the pattern of flow around the ladle block 34 of FIGS. 8-10 when the liquid metal level is lower than the top edges 74 of the sidewalls 32. The unique design of the ladle block 34 causes flow 91 to be directed away from the sides 34 of the channel at low levels, while flow 92 can only enter the draining channel at the entry end 84 of the channel. As a result, the ladle block effectively obstructs and impedes the flow of slag toward the outlet 5.

EXAMPLE 1

A ladle drains at a maximum rate of 3 metric tons of liquid steel per minute. Liquid steel density is approximately 7 $ton/m^3$ so the volumetric flow rate is 3/7 $m^3/min$ or 0.007 $m^3/sec$. The minimum channel depth, $D_{min}$, equals $(0.007)^{2/3}$ or 0.037 m or 37 mm. The channel depth must be at least 37 mm for a 3 metric ton/minute throughput. The value chosen for D can be greater than 37 mm for this throughput, but cannot be less. The maximum channel width, $W_{max}$, depends on the actual depth of the channel, D, and the value calculated for $D_{min}$. If the value chosen for D is equal to $D_{min}$, i.e. $D=D_{min}$, then the maximum channel width, in accordance with equation (2), is 1.5 m. Similarly in accordance with equation (3), the minimum width of the channel, $W_{min}$, is 0.5 m. Thus channel depth, W, must be between 0.5 and 1.5 m. If the value chosen for W is 1.0 m, then in accordance with equation (4), the minimum channel length, $L_{min}$, must be at least equal to 0.5 times W, which means that the actual channel length, L, must be at least 0.5 m. To summarize this example, for a ladle draining at a maximum rate of 3 metric tons of steel per minute, the channel of the ladle block will have a channel depth of at least 37 mm; a channel width from 0.5 to 1.5 m, and a channel length of at least 0.5 m.

EXAMPLE 2

A ladle includes a bottom consisting essentially of a ladle block of the present invention. The ladle block includes three terraces separated by channels. One channel is an outlet channel and terminates in a well defining an outlet. The outlet channel has a width, length and depth corresponding to equations 1-4. Because the ladle block forms substantially the entire ladle bottom, the outlet channel length easily exceeds $L_{min}$ and the width and depth are chosen with convenient dimensions.

Obviously, numerous modifications and variations of the present invention are possible. It is, therefore, to be understood that within the scope of the following claims, the invention may be practiced otherwise than as specifically described.

What is claimed is:

1. A ladle block for use in a bottom of a ladle that transfers molten metal at a flow rate, Q, the ladle block comprising a floor defining an outlet having a center; at least two sidewalls substantially orthogonal to the floor and having a top edge; and an entry end, the sidewalls and floor defining a single channel having a length, L, equal to a distance from the entry end to the center of the outlet, a width, W, equal to a distance between the sidewalls and a depth, D, equal to a distance from the floor to the top edges, where $K_1$, $K_2$, $K_3$ and $K_4$ are non-zero constants dependent upon the units of measurement; and a) D is at least equal to a minimum depth, $D_{min}$;

b) $D_{min}=K_1 \cdot Q^{2/3}$;

c) W is no greater than $K_2 \cdot D_{min}/D$ and no less than $K_3 \cdot D_{min}/D$; and d) L is at least $K_4 \cdot W$.

2. The ladle block of claim 1, wherein uppermost faces extend from the sidewalls.

3. The ladle block of claim 2, wherein the uppermost faces extend from the top edges of the sidewalls.

4. The ladle block of claim 2, wherein the uppermost faces tilt away from the channel.

5. The ladle block of claim 1, wherein the ladle block includes an end wall and the floor, sidewalls, and end wall define the channel.

6. The ladle block of claim 5, wherein uppermost faces extend from the sidewalls and end wall.

7. The ladle block of claim 6, wherein the uppermost faces tilt away from the channel.

8. The ladle block of claim 1, wherein $K_1=1.0$, $K_2=1.5$, $K_3=0.5$, $K_4=0.5$ and Q is in $m^3/s$, and the dimensions of depth, width and length are in meters.

9. A ladle block for use in a bottom of a ladle that transfers molten metal at a flow rate, Q, where Q is in $m^3/s$, the ladle block comprising a floor defining an outlet having a center; at least two sidewalls substantially orthogonal to the floor; an end wall substantially orthogonal to the floor; and an entry end opposite the end wall; the sidewalls and end wall including a top edge, the sidewalls, end wall and floor defining a single channel having a length, L, equal to a distance from the entry end to the center of the outlet; a width, W, equal to a distance between the sidewalls; a depth, D, equal to a distance from the floor to the top edges; $K_1=1.0$, $K_2=1.5$, $K_3=0.5$, $K_4=0.5$ when the dimensions of depth, width and length are in meters; and a) D is at least equal to a minimum depth, $D_{min}$;

b) $D_{min}=K_1 \cdot Q^{2/3}$;

c) W is no greater than $K_2 \cdot D_{min}/D$ and no less than $K_3 \cdot D_{min}/D$; and d) L is at least $K_4 \cdot W$.

10. The ladle block of claim 9, wherein uppermost faces extend from the sidewalls and end wall, and the uppermost faces tilt away from the channel.

11. A ladle for transferring liquid metal at a flow rate, Q, comprising a bottom surface and a ladle block set into the bottom surface, the ladle block comprising a floor defining an outlet having a center; at least two sidewalls substantially orthogonal to the floor and having a top edge; and an entry end, the sidewalls and floor defining a single channel having a length, L, equal to a distance from the entry end to the center of the outlet, a width, W, equal to a distance between the sidewalls and a depth, D, equal to a distance from the floor to the top edges, where $K_1$, $K_2$, $K_3$ and $K_4$ are non-zero constants dependent upon the units of measurement; and a) D is at least equal to a minimum depth, $D_{min}$;

b) $D_{min}=K_1 \cdot Q^{2/3}$;

c) W is no greater than $K_2 \cdot D_{min}/D$ and no less than $K_3 \cdot D_{min}/D$; and d) L is at least $K_4 \cdot W$.

12. The ladle of claim 11, wherein the floor of the ladle block is below the bottom surface.

13. The ladle of claim 11, wherein the top edges of the ladle block are above the bottom surface

14. The ladle of claim 11, wherein $K_1=1.0$, $K_2=1.5$, $K_3=0.5$, $K_4=0.5$ when the dimensions of depth, width and length are in meters.

* * * * *